United States Patent [19]

Schellenberg

[11] 4,337,705

[45] Jul. 6, 1982

[54] RESILIENTLY INTERCONNECTED PIVOTED TRUCKS

[75] Inventor: Rudolf Schellenberg, Effretikon, Switzerland

[73] Assignee: Schweizerische Lokomotiv und Maschinenfabrik, Winterthur, Switzerland

[21] Appl. No.: 892,880

[22] Filed: Apr. 3, 1978

[30] Foreign Application Priority Data

Feb. 10, 1978 [CH] Switzerland ..... 1499/78

[51] Int. Cl.[3] ..... B61F 5/00; B61F 5/38; B61F 13/00

[52] U.S. Cl. ..... 105/168; 105/176; 308/72

[58] Field of Search ..... 105/165–169, 105/176, 4 R, 199 A; 308/72, 237 A

[56] References Cited

U.S. PATENT DOCUMENTS

| | | | |
|---|---|---|---|
| 1,618,354 | 2/1927 | Ritt | 308/72 |
| 1,728,096 | 9/1929 | Algrain | 105/168 |
| 2,368,886 | 2/1945 | Schroeter | 308/72 |

FOREIGN PATENT DOCUMENTS

| | | | |
|---|---|---|---|
| 189500 | 5/1964 | Sweden | 105/4 R |

*Primary Examiner*—Joseph F. Peters, Jr.
*Assistant Examiner*—Howard Beltran

[57] ABSTRACT

The cross-coupling arrangement for coupling the end trucks to each other has a longitudinal shaft which is mounted via universal bearings at opposite ends on journal pins which are fixedly mounted relative to the vehicle. The shaft is articulated to the trucks via levers which are disposed at least approximately in the proximity of the transverse plane of the universal bearings.

10 Claims, 6 Drawing Figures

Fig.1
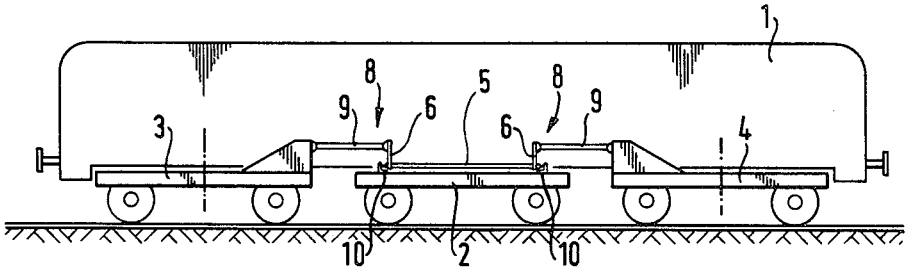
Fig.2
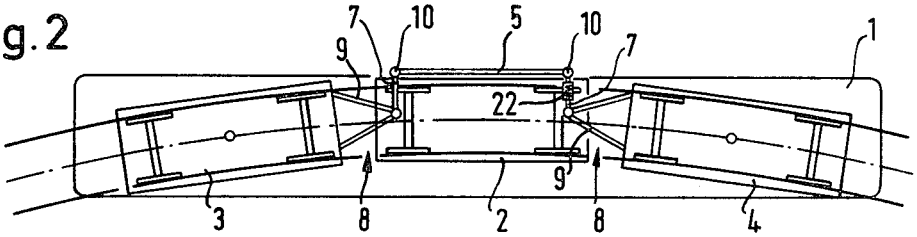
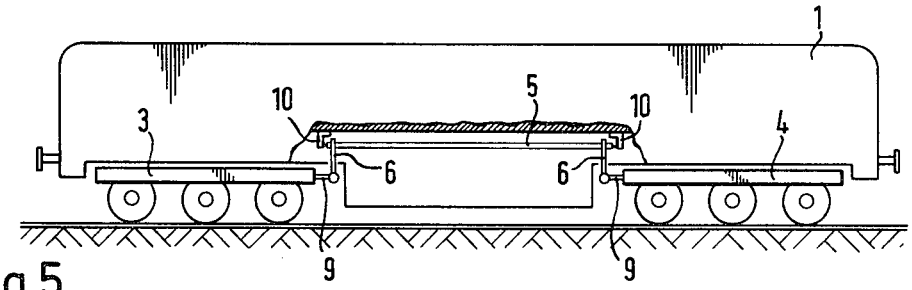
Fig.5
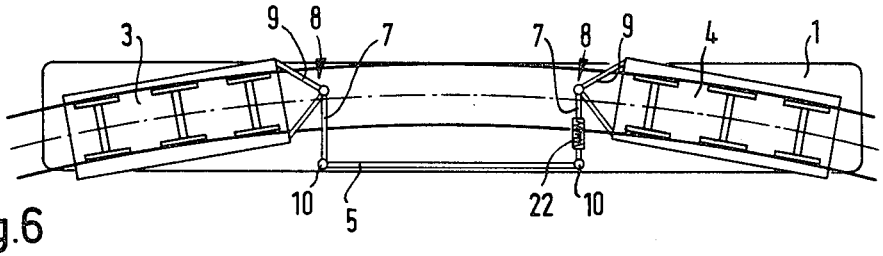
Fig.6

RESILIENTLY INTERCONNECTED PIVOTED TRUCKS

This invention relates to a cross-coupling arrangement and particularly to a cross-coupling arrangement for a rail vehicle having at least two trucks.

As is known, rail vehicles have been provided with two or three trucks, i.e. under carriages, in order to move along a set of rails or track. In many instances, it has also been known to couple the two end trucks to each other at the ends facing each other or, in the case of a three truck arrangement, to couple the two end trucks to the ends of the middle truck. Generally, use is made of a cross-coupling arrangement in which horizontal forces can be transmitted from one truck to the other. This permits a reduction of the forces which act on the wheel sets of the end trucks, particularly between the flanges of the wheels and the rails, when a track curve is traversed. In one known arrangement, use has been made of a torsion shaft and cross-links. Usually, the torsion shaft is supported on the middle truck or on the vehicle body, in which case, the torsion shaft bypasses the middle truck. Specifically, in a cross-coupling arrangement, the ends of the end trucks which face each other are coupled together by means of a linkage which comprises a torsion shaft supported in bearings on the middle truck, two levers of equal length which are disposed in parallel relation to each other and which are fastened to the shaft, and two rods which connect the lever ends to the ends of the trucks.

However, such a cross-coupling arrangement permits the levers which are fastened to the torsion shaft to exert forces on the shaft which cause heavy bending stresses in the shaft. This, in turn, requires a large shaft diameter. Further, if a heavy bending stress is to be avoided, the levers must be offset so that they lie in the same transverse plane as the bearings. However, such a lever construction is complicated and cumbersome. Further, the levers must be constructed so as to take on not only the bending stress but also the shear and torsion stresses. In addition, the shaft is still stressed in flexure in the region between the support and the lever.

Accordingly, it is an object of the invention to provide a cross-coupling arrangement of simplified construction.

It is another object of the invention to provide a cross-coupling arrangement which employs levers constructed without offsets.

It is another object to impose a minimum of bending stress on a torsion shaft.

Briefly, the invention provides a cross-coupling arrangement for coupling at least two trucks of a rail vehicle together. The cross-coupling arrangement includes a shaft which has a coaxial cylindrical cavity at each end, a pair of universal bearings which are mounted in the respective cavities of the shaft, a pair of journal pins and a pair of levers. Each journal pin is secured to a respective bearing within the shaft and projects from the shaft in order to permit mounting of the shaft on an axis of rotation longitudinally of the shaft. Each lever is fastened to an end of the shaft and is arranged at least approximately in the proximity of the transverse plane of the universal bearing at each end of the shaft.

The cross-coupling arrangement is generally utilized between at least two trucks of a rail vehicle. In this regard, the shaft is disposed to extend longitudinally of the vehicle and each pin which projects from the shaft is mounted in fixed relation to the vehicle via a support bracket. For this purpose, each pin has a conical part received within a clamping sleeve within each support bracket as well as a cylindrically threaded part which projects through the sleeve and receives a nut. The nut is threaded onto the threaded pin part against the clamping sleeve in order to fix the pin relative to the support bracket.

The universal bearing which is used in the cross-coupling arrangement may be of any suitable construction. For example, the bearing may include an outer ring secured to the shaft in non-rotatable manner and an inner ring within the outer ring and secured to a respective journal pin in non-rotatable manner.

The levers of the cross-coupling arrangement form part of a linkage which connects each end of the shaft with a respective one of the trucks of the rail vehicle. In the case where the rail vehicle has three trucks, the support brackets can be secured to the middle truck or to the rail vehicle.

The cross-coupling arrangement has the advantage that the levers which are fastened to the shaft can be of particularly simple construction. As such, the levers require a relatively small effort for fabrication and installation. Further, the shaft remains practically free of bending stresses along its entire length and only torsional stress needs to be taken into consideration in the shaft design. Further, the bearings need to be designed, regardless of the shaft diameter, only on the basis of the bearing load and need not be made unnecessarily long.

In one embodiment of the invention which allows an advantageously simple force flow with an advantageous stressing of the shaft, the linkage contains two levers which are fastened to each end of the shaft and which are arranged at least approximately in the proximity of the transverse plane of the inner bearing.

In another embodiment, a statically optimal transmission of the cross-coupling forces can be achieved if the levers each have a plane of symmetry which coincides at least approximately with the transverse plane of the inner universal bearing.

Where the journal pins are fastened in a support bracket, the cross-coupling arrangement is particularly well suited for railroad operation and has simple components which require little maintenance.

These and other objects and advantages of the invention will become more apparent from the following detailed description taken in conjunction with the accompanying drawings wherein:

FIG. 1 illustrates a side elevational view of a rail vehicle having three trucks coupled together by a cross-coupling arrangement in accordance with the invention;

FIG. 2 illustrates a top view of FIG. 1 assuming the vehicle is in a track curve;

FIG. 5 illustrates a side elevational view of a rail vehicle having two cross-coupled trucks in accordance with the invention; and FIG. 6 illustrates a top view of FIG. 5 assuming the vehicle is in a track curve.

Figure 4:
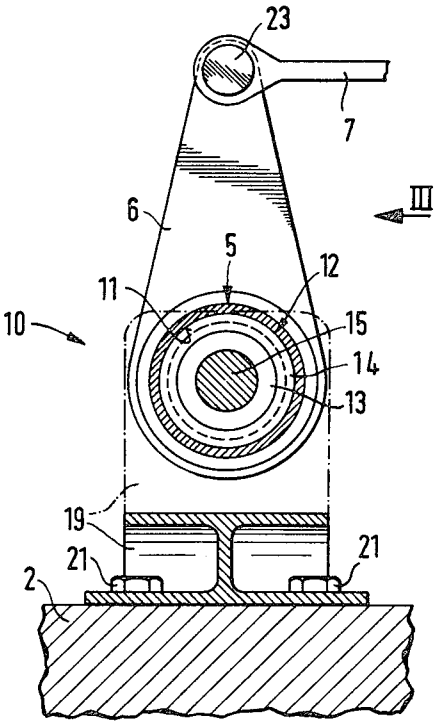
FIG. 4 illustrates a view taken on line IV—IV of FIG. 3.

Referring to FIGS. 1 and 2, the rail vehicle 1 is constructed with three trucks 2, 3, 4 of known construction. As indicated, a cross-coupling arrangement is utilized to couple the end trucks 3, 4 together. This cross-coupling arrangement includes a shaft 5 which extends longitudinally of the rail vehicle 1, a pair of linkages in the form of levers 6, a pair of cross-links 7 and a pair of triangular frames 9. As shown in FIG. 2, the triangular frames 9 are mounted on the ends 8 of the end trucks 3, 4 which face each other. In addition, the cross-link 7, as shown on the right in FIG. 2, is provided with a pretensioned return spring 22 so that the cross-link 7 can operate elastically under a tension load as well as under a compression load.

As shown in FIG. 2, the cross-coupling shaft 5 is linked at the middle truck 2 at two support points 10 which are disposed at a distance from each other in a longitudinal direction. In this way, the levers 6 fixed at the shaft 5 can swing out laterally and the ends 8 of the two end trucks 3,4 can move freely relative to the middle truck 2.

Figure 3:
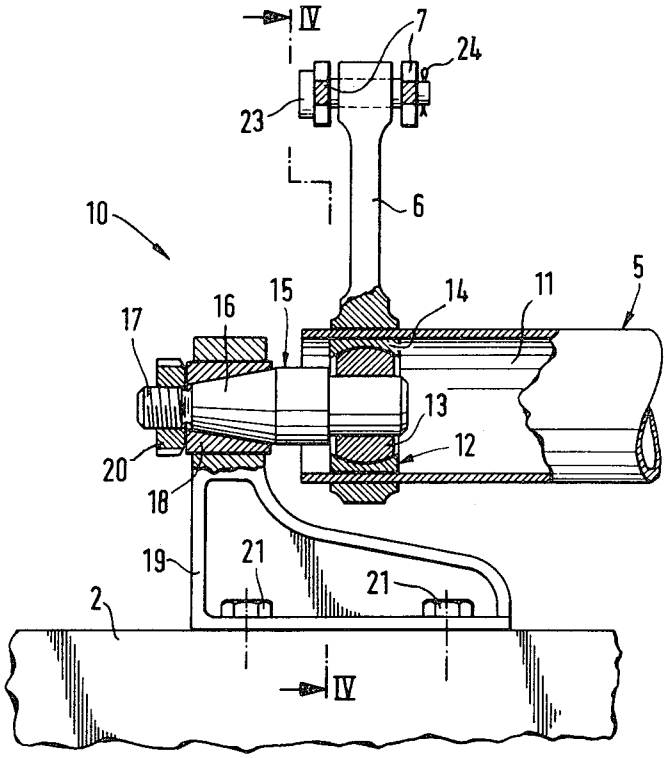
FIG. 3 illustrates a cross-sectional view through one end of the cross-coupling arrangement and through a support at the middle truck in accordance with the invention.

Referring to FIGS. 3 and 4, the cross-coupling shaft 5 is supported at opposite ends in substantially the same manner. Accordingly, only one end need be described in detail. To this end, each end of the shaft 5 has a coaxially cylindrical inner cavity 11 which receives a universal bearing 12, i.e. a ball joint like-bearing. This bearing 12 is constructed with an outer ring 14 which is secured to the shaft 5 in non-rotatable manner and an inner ring 13 which is mounted within the outer ring 14. The mating surfaces of the rings 13, 14 are such as to provide a spherical slide bearing. Alternatively, a self-aligning roller bearing may also be used.

In addition, a journal pin 15 is disposed at each end of the shaft 5 and projects from the shaft 5 to permit mounting of the shaft 5 on an axis of rotation longitudinally of the shaft 5. As indicated in FIG. 3, the inner ring 13 of the bearing 12 is secured to the pin 15 in non-rotatable manner.

The support points 10 are formed by a pair of support brackets 19 positioned at opposite ends of the shaft 5. As shown in FIG. 3, each bracket 19 is positioned to receive a journal pin 15 in fixed relation. For this purpose, each journal pin 15 has a projecting conical part 16 and a cylindrical threaded part 17. The conical part 16 is fitted into a corresponding conical bore of a clamping sleeve 18 in the bracket 19 while a nut 20 is threaded onto the threaded part 17 against the clamping sleeve 18 to fix the pin 15 in stationary manner relative to the support bracket 19. The bracket 19 is secured via screws or bolts 21 to the middle truck 2.

As shown in FIG. 3, the outside diameter of the clamping sleeve 18 is greater than the largest diameter of the journal pin 15. Thus, by removing the nut 20 and sleeve 18 from the support bracket 19, the journal pin 15 can be axially installed or removed through the bore in the bracket 19. As a result, the shaft 5 can be installed and removed without disassembling the brackets 19.

The mounting arrangement of the shaft 5 relative to the truck 2 is such that the bearing rings 13, 14 can turn relative to each other via the spherical bearing surfaces. Thus, the shaft 5 is able to move in angular relationship to the pin 15. By permitting relative rotation of the bearing rings 13, 14 in all directions, the end trucks 3,4 can effect a relative displacement to each other. Also, any alignment error between the shaft 5 and the journal pins 15 can be compensated.

As shown in FIGS. 3 and 4, each lever 6 is fastened to one end of the shaft 5 and is arranged at least approximately in the proximity of the transverse plane of the universal bearing 12 within the cavity 11 of the shaft 5. For example, the plane of symmetry of each lever 6 is coincident with the transverse plane of the respective bearing 12.

Each lever 6 carries a pin 23 at the free end to which a cross-link 7 is linked via a joint (not shown in detail) and secured in place by a cotter pin 24. The cross-links 7 are disposed in parallel relation to each other and establish a connection with the ends 8 of the triangular frames 9 (see FIG. 2).

Referring to FIGS. 5 and 6, wherein like reference characters indicate like parts as above, the cross-coupling arrangement may also be used in a rail vehicle 1 having no middle truck but only two trucks 3,4, for example two three-axle trucks. As illustrated, these end trucks 3, 4 are cross-coupled to each other via a shaft 5, a pair of levers 6, a pair of cross-links 7 and a pair of triangular frames 9. The cross-coupling shaft 5 is supported in the manner as shown in FIGS. 3 and 4 at support points 10; however, the support brackets 19 forming the support points 10 are secured to the vehicle body 1. As above, the cross-links 7 are disposed in parallel relation to each other.

The invention thus provides a cross-coupling arrangement which utilizes a lever of relatively simple construction in a cross-coupling arrangement. In this regard, the overall construction of the cross-coupling arrangement is relatively simple and is made up of simple parts which can be maintained in a relatively easy manner.

When the rail vehicle 1 traverses a track curve as shown in FIG. 2, the triangular frames 8,9 move radially outwardly of the curve. This causes the cross-links 7 to move laterally outwardly in the same direction thereby pivoting the levers 6 about the axis of the shaft 5. The shaft 5 similarly rotates with the levers 6 on the journal pins 15.

What is claimed is:

1. In a cross-coupling arrangement for coupling at least two trucks of a rail vehicle; the combination including

- a shaft having a coaxial cavity at each end thereof; mounted in a respective cavity of said shaft;
- a pair of journal pins, each pin having a conical part and a cylindrical threaded part at one end, each pin being secured to a respective bearing and projecting from said shaft to permit mounting of said shaft on an axis of rotation longitudinally of said shaft;
- a pair of levers each lever being fastened to one end of said shaft and arranged at least approximately in the proximity of the transverse plane of said universal bearing at said end of said shaft;
- a pair of support brackets for mounting on one of a vehicle body and a central truck of the rail vehicle; and
- a clamping sleeve in each respective bracket receiving a respective conical part of a journal pin in mating relation, said sleeve having an outside diameter greater than the largest diameter of said journal pin.

2. In combination with a rail vehicle having two trucks and a body supported on said trucks; a cross-coupling arrangement between said trucks, said arrangement including a shaft extending longitudinally of said vehicle, said shaft having a coaxial cylindrical cavity at each end;

a pair of universal bearings, each universal bearing being mounted in a respective cavity of said shaft;

a pair of support brackets mounted on said body;

a pair of journal pins, each pin being secured in a respective mounting bracket in fixed relation and projecting into a respective cavity of said shaft and secured to a respective universal bearing to permit rotation and angular movement of said shaft relative to said pins; and a pair of linkages, each said linkage connecting a respective end of said shaft with a respective one of said trucks, each linkage including a lever fastened at one end of said shaft and arranged at least approximately in the proximity of a transverse plane of said universal bearing at said end of said shaft.

3. The combination as set forth in claim 1 wherein each universal bearing includes an outer ring secured to said shaft in fixed manner and an inner ring within said outer ring and secured to a respective pin in a fixed manner.

4. The combination as set forth in claim 2 wherein each lever has a plane of symmetry coincident with the transverse plane of a respective universal bearing.

5. The combination as set forth in claim 2 wherein each pin has a conical part and a cylindrical threaded part at an end opposite said shaft, and each support bracket has a clamping sleeve therein receiving said conical part in mating relation, and which further includes a nut threaded onto said threaded part of each respective pin against a respective clamping sleeve to fix said pin relative to said support bracket.

6. The combination as set forth in claim 5 wherein said sleeve has an outside diameter greater than the largest diameter of said journal pin.

7. In combination with a rail vehicle having three trucks; a cross-coupling arrangement between said trucks, said arrangement including a shaft extending longitudinally of said vehicle, said shaft having a coaxial cylindrical cavity at each end;

a pair of universal bearings, each universal bearing being mounted in a respective cavity of said shaft;

a pair of support brackets mounted on a middle one of said trucks;

a pair of journal pins, each pin being secured in a respective mounting bracket in fixed relation and projecting into a respective cavity of said shaft and secured to a respective universal bearing to permit rotation and angular movement of said shaft relative to said pins; and a pair of linkages, each said linkage being fastened to a respective end of said shaft to connect said one end of said shaft with a respective outer one of said trucks, each linkage including a lever fastened to one end of said shaft and arranged at least approximately in the proximity of a transverse plane of said universal bearing at said end of said shaft.

8. The combination as set forth in claim 7 wherein each universal bearing includes an outer ring secured to said shaft in non-rotatable manner and an inner ring within said outer ring and secured to a respective pin in non-rotatable manner.

9. The combination as set forth in claim 7 wherein each pin has a conical part and a cylindrical threaded part at an end opposite said shaft, and each support bracket has a clamping sleeve therein receiving said conical part in mating relation, and which further includes a nut threaded onto said threaded part of each respective pin against a respective clamping sleeve to fix said pin relative to said support bracket.

10. The combination as set forth in claim 9 wherein said sleeve has an outside diameter greater than the largest diameter of said journal pin.

* * * * *

UNITED STATES PATENT AND TRADEMARK OFFICE

CERTIFICATE OF CORRECTION

PATENT NO. : 4,337,705

DATED : July 6, 1982

INVENTOR(S) : Rudolf Schellenberg

It is certified that error appears in the above—identified patent and that said Letters Patent is hereby corrected as shown below:

Col. 4, line 46 delete "mounted in a respective cavity of said shaft" and insert --a pair of universal bearings, each bearing being mounted in a respective cavity of said shaft;--

Signed and Sealed this

*Seventh* Day of *September 1982*

[SEAL]

*Attest:*

GERALD J. MOSSINGHOFF

*Attesting Officer*

*Commissioner of Patents and Trademarks*